US009428939B2

(12) United States Patent
Fontana et al.

(10) Patent No.: US 9,428,939 B2
(45) Date of Patent: Aug. 30, 2016

(54) LOCKING/UNLOCKING SYSTEM FOR SUPERIMPOSABLE ELEMENTS

(71) Applicants: Fabio Fontana, Rome (IT); Massimo Fontana, Guidonia (IT)

(72) Inventors: Fabio Fontana, Rome (IT); Massimo Fontana, Guidonia (IT)

( * ) Notice: Subject to any disclaimer, the term of this patent is extended or adjusted under 35 U.S.C. 154(b) by 127 days.

(21) Appl. No.: 13/658,580

(22) Filed: Oct. 23, 2012

(65) Prior Publication Data

US 2013/0283867 A1 Oct. 31, 2013

Related U.S. Application Data

(63) Continuation of application No. PCT/IT2011/000135, filed on May 3, 2011.

(30) Foreign Application Priority Data

May 4, 2010 (IT) ..... RM2010A0212

(51) Int. Cl.
*E05B 47/00* (2006.01)
*E05B 73/00* (2006.01)
*E05B 17/14* (2006.01)

(52) U.S. Cl.
CPC ..... *E05B 47/0038* (2013.01); *E05B 17/14* (2013.01); *E05B 73/0052* (2013.01); *Y10T 70/7955* (2015.04)

(58) Field of Classification Search
CPC ..... E05B 47/0038; E05B 47/0042; E05B 47/0043; E05B 47/0044; E05B 47/0045; E05B 73/0047; E05B 73/0052
USPC ..... 70/276, 413
See application file for complete search history.

(56) References Cited

U.S. PATENT DOCUMENTS

| | | | | |
|---|---|---|---|---|
| 3,837,195 | A * | 9/1974 | Pelto | 70/276 |
| 3,967,479 | A * | 7/1976 | Vick | 70/276 |
| 3,974,669 | A * | 8/1976 | Stackhouse | 70/276 |
| 4,022,038 | A * | 5/1977 | Miller | 70/276 |
| 4,285,220 | A * | 8/1981 | Kajita | 70/276 |
| 4,380,162 | A * | 4/1983 | Woolfson | 70/276 |

(Continued)

FOREIGN PATENT DOCUMENTS

DE 4125333 A1 2/1993

OTHER PUBLICATIONS

International Search Report Sep. 7, 2011.

*Primary Examiner* — Christopher Boswell
(74) *Attorney, Agent, or Firm* — Hedman & Costigan, P.C.; James V. Costigan; Kathleen A. Costigan

(57) ABSTRACT

The present invention relates to a Locking/unlocking system of superimposable elements, comprising a first element (2) or upper element, and a second element (3), or lower element, to be locked and unlocked, superimposed each other along a plane (4) of relative motion, and a operating device (1), said system being characterized in that said first element (2) and said second element (3) provide each one the same number of a plurality of housings (210, 310), and reciprocally positioned so as to form pairs of housings (210, 310), each one providing inside centering means (220, 320), said system being further characterized in that it provides a plurality of first magnetic elements (230') having a first length, a plurality of second magnetic elements (230") having a second length, lower than the length of said plurality of first magnetic elements (230'), and a plurality of third magnetic elements (230').

17 Claims, 2 Drawing Sheets

(56) References Cited

U.S. PATENT DOCUMENTS 7,621,161 B2 11/2009 Fontana
2007/0113605 A1* 5/2007 Lopez ..... 70/276
2008/0190152 A1* 8/2008 Fontana et al. ..... 70/276
2010/0319418 A1* 12/2010 Piron ..... 70/276

* cited by examiner

LOCKING/UNLOCKING SYSTEM FOR SUPERIMPOSABLE ELEMENTS

The present invention relates to a locking/unlocking system for superimposable elements, and in particular it refers to a magnetic locking/unlocking system for superimposable elements, which exploits the interaction of magnetic elements, ferromagnetic elements or elements that are magnetically inert each other.

In the following description will be directed specifically to an embodiment in the field of locks, either directly as a lock or as a protection of the same, but it is well evident that the patent application should not be regarded as limited to this specific area of use.

In the field of locks, an important issue is security: the easy accessibility of the keyhole of a lock makes any lock or locking system vulnerable to vandalism, violations and/or tampering by unauthorized parties.

A known solution that has been implemented is the one described in the U.S. Pat. No. 7,621,161, in the name of the same applicants, which is a magnetic system for the unlocking of padlocks and locks comprising a lock-cover element which alternatively permits or prevents access to the lock keyhole and to a device, and an operating element that alternatively blocks and unblocks the lock-cover element; the lock cover element has one or more pin elements so as to allow the lock-cover element to be rotated with respect to a plate element; the lock-cover element and the plate element provide each one the same number of a plurality of holes, inside which there are one or more magnetic pin elements, having two possible measurements, one longer and one shorter, being attracted towards the device by the metal of the same device or by a platelet inside the plate element; the operating element has grasping means, that allow its positioning and its rotating, and an arrangement of elements is housed inside the holes, the elements being made up of ferromagnetic material or magnetically inert material, suitable for attract or not, the magnetic elements, depending on their length, that are housed within the plurality of holes provided on the element plate, so that they line up all on the same plane, so they can rotate.

The latter system has the limit in that it can be realized in a number of combinations corresponding to the number of possible alternative configurations into the holes on the plate element, in other words two, raised to the number of said holes.

It is then object of the present invention to overcome the above drawbacks, providing a locking/unlocking system for superimposable elements, that allows to obtain more combinations, with the same number of holes on the plate element.

It is a further object of the present invention to completely eliminate the need for the presence of a key-hole of a lock, the operating element being an element of the lock being a plate element and superimposable to the device itself.

It is a further object of the present invention to be easy to achieve.

It is therefore the specific subject-matter of the present invention a locking/unlocking system of superimposable elements, comprising a first element or upper element, and a second element, or lower element, to be locked and unlocked, superimposed each other along a plane of relative motion, and an operating device, said system being characterized in that said first element and said second element provide each one the same number of a plurality of housings, and reciprocally positioned so as to form pairs of housings, each one providing inside centering means, said system being further characterized in that it provides a plurality of first magnetic elements having a first length, a plurality of second magnetic elements having a second length, lower than the length of said plurality of first magnetic elements, and a plurality of third magnetic elements, having a third length equal to the half of the sum of said first and second lengths, the total height of said pairs of housings having the measure equal to or bigger than the double of said first length, inside each one of said pairs of housings being provided a pair of magnets, consisting of one of said first magnetic elements and of one of said second magnetic elements, or a pair of said third magnetic elements, the position each other and the orientation of their polarity being combined randomly, so that their faced ends correspond to, or are offset with respect to, said plane, said operating device providing a plurality of interference elements, comprised of magnetic material, ferromagnetic material or magnetically inert material, oriented and combined so as to attract, reject or leave unaltered said pairs of magnets so as, bringing said operating device close to one of said two elements, said pairs of magnets are all aligned along said plane, permitting the relative motion of the two elements.

Furthermore, according to the invention, said operating device provides a plurality of interference elements in a corresponding position and in the same number of the ones in said plurality of housings of said first and second element.

Preferably, according to the invention, said operating device further comprises a screening element of said plurality of interference elements, comprised of a magnetically inert material.

Furthermore, according to the invention, said pairs of magnets consist of magnets having pairwise identical sections.

Preferably, according to the invention, said plane is the symmetry plane of said housings and of said centering means.

Preferably, according to the invention, said relative motion between said first and second element is a rotation.

Preferably, according to the invention, said relative motion between said first and second element is a linear sliding.

Preferably, said system is applied to a lock system of moveable structures.

Preferably said system is applied to a protection system for a lock.

Preferably, according to the invention, said centering means consist each one of pairs of tubular elements comprised of ferromagnetic material, inside which there are said pairs of magnets.

Still according to the invention, said centering means consist each one of two hollow plates in ferromagnetic material, inside which there are said pairs of magnets.

Still according to the invention, said centering means consist each one of two magnetic elements positioned at the sides of each one of said housings, inside which there are said pairs of magnets.

Still according to the invention, said centering means consist each one of magnetically inert springs at the free ends of said pairs of magnets.

Still according to the invention, said operating device further has grasping means.

Always according to the invention, said operating device has first means of engagement and in that said first element has second means of engagement, said first and second means of engagement being shaped so as said operating device, positioned on said first element, couples with the latter, integrally moving with the same.

Finally, said first and second means of engagement consist of a projecting part and of a hollow, shaped such as to be reciprocally engaged, provided, respectively on said operating device and on said first element, or vice versa.

Figure 1:
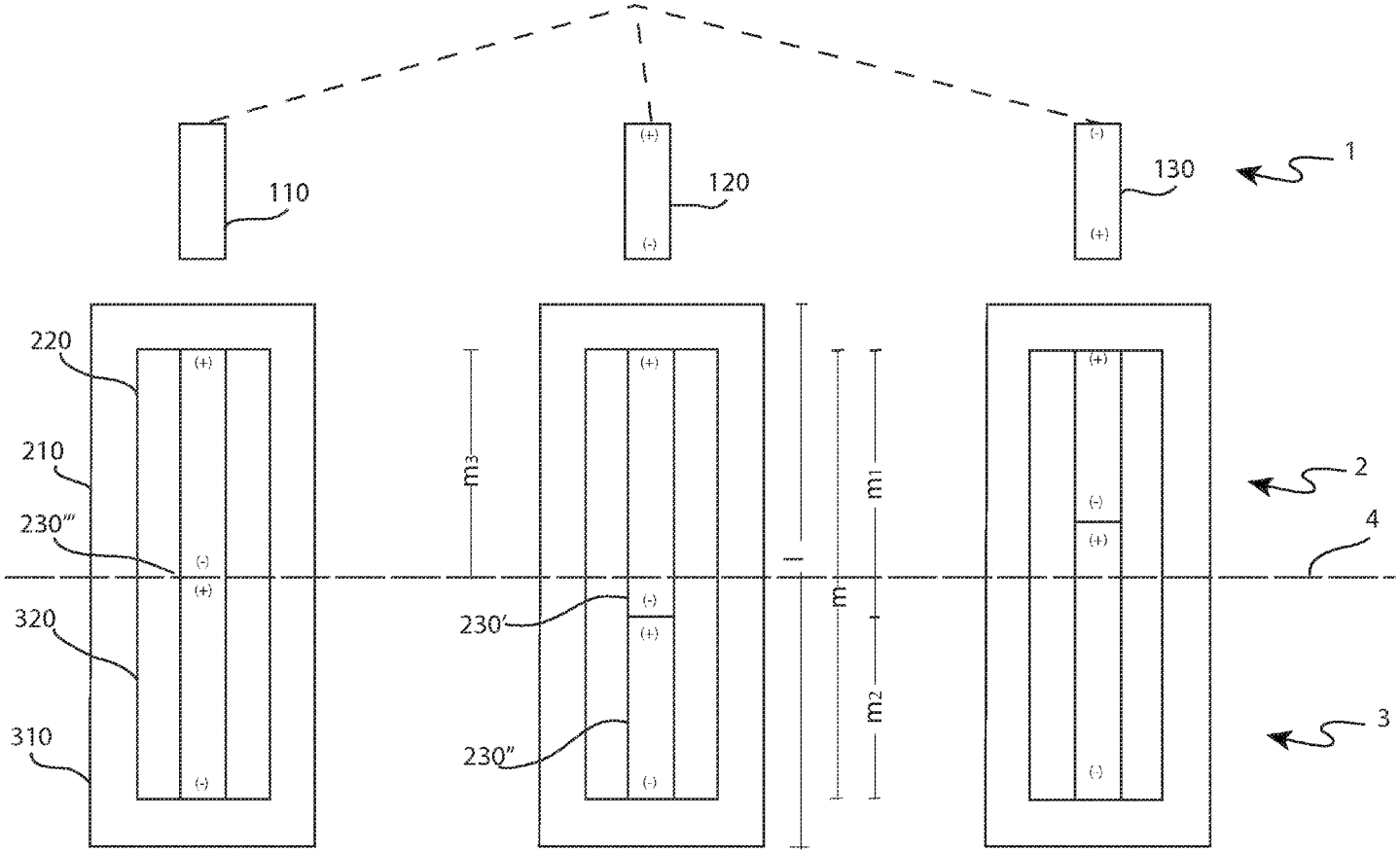
FIG. 1 is schematic drawing of a locking/unlocking system according to the present invention.
Figure 2:
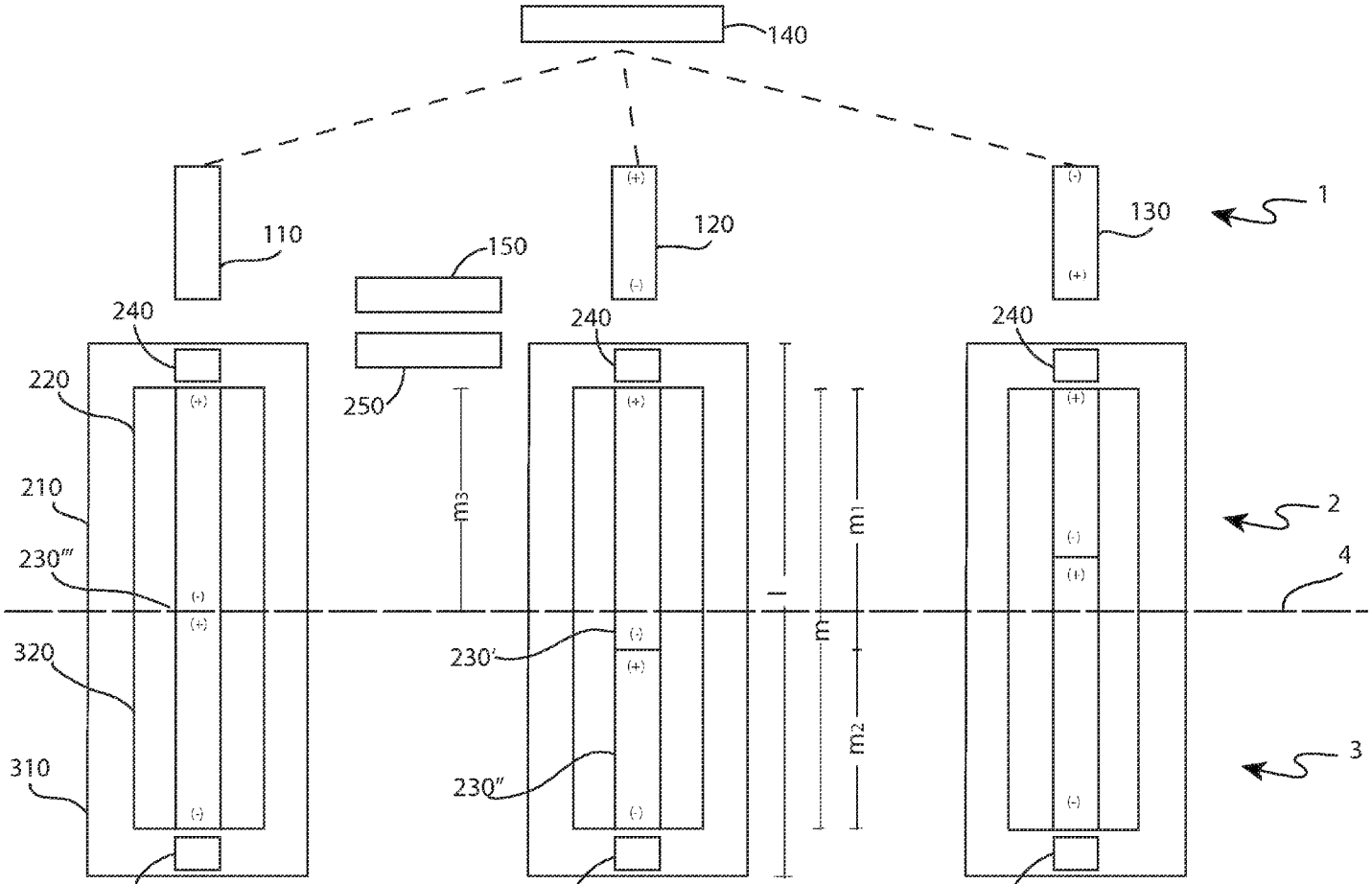
FIG. 2 is a schematic drawing of a locking/unlocking system according to the present invention which uses a magnetically inert spring between two magnets and grasping means.

The present invention will be now describe, for illustrative but not limitative purposes, according to its preferred embodiment, with particular reference to FIG. 1 and FIG. 2 of the drawings, wherein the operation of the device according to the invention is schematically shown.

With reference to FIG. 1 and FIG. 2, the system according to the invention provides an operating device 1, a first element 2 and a second element 3. The operating device 1 provides a plurality of operating elements 110, 120, 130, which can be comprised of a magnet 120, 130, or of a magnetically inert element 110. In case it is a magnet 120, 130, it can be oriented with its negative polarity 120, or positive polarity 130, facing the first element 2.

The first element 2 and the second element 3 provide a plane 4 of relative motion, and a plurality of pairs of cylindrical housings 210, 310, the housings of each pair having the same position and dimension, and being in the same number of the operating elements provided on the operating device 1. Within each pair of housings 210, 310 there is a centering means 220, 320, in this case consisting of a pair of tubular elements comprised of ferromagnetic material, the tubular elements of each pair having the same position and dimension, inside which there is a pair of cylindrical magnets 230', 230" or 230''', 230''', the magnets 230 of which pair have the same section and can present three different lengths, $m_1$, $m_2$, $m_3$. The pairs of housings 210, 310 and the relative pairs of tubular elements 220, 320 are all aligned with the facing ends placed along the plane 4. The total height I of each pair of housings 210, 310 is bigger than the total length m of the pair of magnets 230', 230" or 230''', 230''', with $m=m_3+m_3=m_1+m_2$ and $1=2\ m_1$.

Each pair of magnets 230', 230" or 230''', 230''', once made up, acts as a single magnet, having their facing polarities oriented so as to be attracted, tending to be positioned exactly at the center of the pair of ferromagnetic tubular elements 220, 320, in absence of interferences.

The term "tubular" has to be understood here in its broadest meaning, in other word in the meaning of a hollow element, not necessarily with a round cross section. It is evident that such pair of tubular elements 220, 320 described here, comprised of ferromagnetic material, has the function to keep—in absence of interferences—the center of gravity of the pair of magnets on the plane 4, a function that can be carried out in many other ways, i.e. using only two hollow plates placed at the same distance from the plane 4, or putting two magnets at the sides of each pair of housings 230', 230" or 230''', 230''', or further putting a magnetically inert spring 240 (as shown in FIG. 2 at each of the free ends of the pair of magnets.

When the pair of magnets is made up of a magnet 230' with a length $m_1$ and a magnet 230" with a length $m_2$ smaller than the length $m_1$, the two facing ends are offset to the plane 4, avoiding the relative motion between the first element 2 and the second element 3 along the sliding plane 4. More precisely, in case the magnet 230' with the length $m_1$ is within the first element 2, it is necessary, to make the facing ends to align along the plane 4, that the operating device 1 provide, in the position corresponding to the position of that hole, a magnetic operating element 120, 130, with the polarity facing to the first element 2 contrary to the polarity of the magnet facing to the operating device 1, so as it attracts the pair of magnets 230', 230".

In case the magnet 230' with the length $m_1$ is in the second element 3, it is necessary, to make the facing ends to align along the plane 4, that the operating device 1 provide, in the position corresponding to the position of that hole, a magnetic operating element 120, 130, with the polarity facing to the first element 2 that is the same polarity of the magnet facing to the operating device 1, so as it rejects the pair of magnets 230', 230".

When the pair of magnets is comprised of two magnets 230''', each having a length $m_3$, the facing ends are placed along the plane 4. To keep the facing ends along the plane 4, it is necessary that the operating device 1 provides, in the position corresponding of the position of that hole, a magnetically inert operating element 110.

Since the operating device 1 provides a combination of operating elements 110, 120, 130, suitable for aligning all the facing ends of each pair of magnets 230', 230" or 230''', 230''' along the plane 4, a relative motion between the first element 2 and the second element 3 is possible, the operating device 1 acting as a key. In such a way, the number of possible combination is equal to the number of the possible alternative configurations within the pair of housings 210, 310 provided in the first element 2 and in the second element 3, in this case three, raised to the number of the pairs of housings 210, 310.

According to a favourite embodiment, not shown in FIG. 2, the operating device 1 comprises grasping means 140, i.e. a handle, and first means of engagement 150, i.e. a projecting part or a hollow. The first element 2 further comprises second means of engagement 250, i.e. a hollow or a projecting part, shaped such as the operating device 1, coupled to the first element 2 is engaged to the latter, by means of the coupling of the first and the second means of engagement, so as, moving the operating device 1, the corresponding movement of the first element 2 is obtained.

Advantageously, the relative motion between the first element 1 and the second element 2, which may be for example a linear slide or a rotation, is connected to a locking device, such as a lock, or it constitutes a protection system for an already existing known lock.

Obviously, banal expedients allow the creation of further possible alternative configurations inside the housings 210, 310, to increase the number of power to which the number of pairs of housings 210, 310 has to be raised, to obtain, as a result, the number of possible combinations.

Advantageously, the system according to the invention can be applied in systems of opening/closing of rooms, in the absence of shown mechanisms, as required by the modern requirements for design and attention to architectural details.

The present invention has been described to illustrate and not for limiting purposes, according to its preferred embodiments, but it is to be understood that modifications and/or changes can be introduced by those skilled in the art without departing from the relevant scope as defined in the appended claims.

The invention claimed is:

1. Locking/unlocking system of superimposable elements, comprising a first element (2) or upper element, and a second element (3), or lower element, to be locked and unlocked, superimposed each other along a plane (4) of relative motion, and a operating device (1), said operating device (1) providing a plurality of interference elements (110, 120, 130), comprised of magnetic (120, 130) material, ferromagnetic material or magnetically inert (110) material, said first element (2) and said second element (3) providing each one the same number of a plurality of housings (210; 310), said plurality of housings (210; 310) of said first element (2) and of said second element (3) being reciprocally positioned so as to form aligned pairs of housings (210, 310), each one of said pairs of housings (210; 310) providing inside centering means (220, 320, 240), said system further providing a plurality of first magnetic elements (230') having a first length, a plurality of second magnetic elements (230") having a second length, lower than the length of said plurality of first magnetic elements (230'), and a plurality of third magnetic elements (230"), having a third length equal to one half of the sum of said first and second lengths, the total height of said pairs of housings (210, 310) having a length equal to or longer than the double of said first length, inside each one of said pairs of housings (210, 310) being provided a pair of said magnetic elements (230', 230"; 230'") wherein said pairs of magnetic elements (230', 230", 230'" have a centre of gravity, each pair of said magnetic elements (230', 230"; 230'") consisting of one of said first (230') magnetic elements and of one of said second (230") magnetic elements, or a pair of said third (230") magnetic elements, each magnetic element (230', 230", 230'") of said pair of magnetic elements (230', 230"; 230'") having two ends, each of said ends having only one polarity and said only one polarity being opposite to the polarity of the other end of the same magnetic element (230', 230", 230'")

in each pair of said magnetic elements (230', 230"; 230'"), the position of each magnetic element (230', 230", 230'") with respect to the other magnetic element (230', 230", 230'") of the respective pair and the orientation of their polarity being combined randomly, so that the faced ends of the magnetic elements (230', 230", 230'") of each pair always have opposite polarity, and so that in the absence of interferences said faced ends of said pair of first and second magnetic elements (230', 230") correspond to said plane (4), and said faced ends of said pair of third magnetic elements (230") are offset with respect to said plane (4), and wherein in the absence of interferences, said centering means (220, 320, 240) act on said pairs of magnetic elements (230', 230"; 230'") for keeping said centre of gravity of said pairs of magnetic elements (230', 2/30"; 230'") on said plane (4), so that when both (a): each pair of said magnetic elements (230', 230"; 230'") is subject to a rejection force and (b): each pair of said magnetic elements (230', 230"; 230'") is subject to an attraction force provoked by one of said plurality of interference elements (110, 120) made of magnetic or ferromagnetic material, said center of gravity of said pairs of magnetic elements (230', 230"; 230'") cannot be kept on said plane (4) causing the movement of said pairs of magnetic elements (230', 230"; 230'") within their respective pair of housings (210, 310), said plurality of interference elements (110, 120, 130) of said operating device (1), being oriented and combined so that by bringing said operating device (1) close to one of said two elements (2, 3), one of said plurality of interference elements (110, 120, 130) only attracts or only rejects said pair of said first (230') and said second (230") magnetic elements in the respective pair of housings (210, 310) and only leaves unaltered said pair of said third magnetic elements 1230'") in the respective pair of housings (210, 310), so that said faced ends of said pairs of magnetic elements (230', 230"; 230'") are all aligned along said plane (4), permitting the relative motion of the two elements (2, 3).

2. Locking/unlocking system of superimposable elements according to claim 1, characterized in that said operating device (1) provides a plurality of interference elements (110, 120, 130) in a corresponding position and in the same number of the ones in said plurality of housings (210, 310) of said first (2) and second element (3).

3. Locking/unlocking system of superimposable elements according to claim 1, characterized in that said operating device (1) further comprises a screening element of said plurality of interference elements (110), comprised of a magnetically inert material.

4. Locking/unlocking system of superimposable elements according to claim 1, characterized in that said pairs of magnets (230) consist of magnets having pairwise identical sections.

5. Locking/unlocking system of superimposable elements according to claim 1, characterized in that said plane (4) is the symmetry plane of said housings (210, 310) and of said centering means (220, 320).

6. Locking/unlocking system of superimposable elements according to claim 1, characterized in that said relative motion between said first (2) and second (3) element is a rotation.

7. Locking/unlocking system of superimposable elements according to claim 1, characterized in that said relative motion between said first (2) and second (3) element is a linear sliding.

8. Locking/unlocking system of superimposable elements according to claim 1, characterized in that it is applied to a lock system of moveable structures.

9. Locking/unlocking system of superimposable elements according to claim 1, characterized in that it is applied to a protection system for a lock.

10. Locking/unlocking system of superimposable elements according to claim 1, characterized in that said centering means (220, 320) consist each one of pairs of tubular elements (220, 320) comprised of ferromagnetic material, inside which there are said pairs of magnets (230', 230"; 230'", 230").

11. Locking/unlocking system of superimposable elements according to claim 1, characterized in that said centering means (220, 320) consist each one of two hollow plates in ferromagnetic material, inside which there are said pairs of magnets (230', 230"; 230'", 230'").

12. Locking/unlocking system of superimposable elements according to claim 1, characterized in that said centering means (220, 320) consist each one of two magnetic elements positioned at the sides of each one of said housings (21, 31; 210, 310), inside which there are said pairs of magnets (230', 230"; 230''', 230''').

13. Locking/unlocking system of superimposable elements according to claim 1, characterized in that said centering means (220, 320) consist each one of magnetically inert springs (240) at the free ends of said pairs of magnets (230', 230"; 230''', 230''').

14. Locking/unlocking system of superimposable elements according to claim 1, characterized in that said operating device (1) further has grasping means (140).

15. Locking/unlocking system of superimposable elements according to claim 1, characterized in that said operating device (1) has first means of engagement (150) and in that said first element (2) has second means of engagement (250), said first and second means of engagement (150, 250) being shaped so as said operating device (1), positioned on said first element (2), couples with the latter, integrally moving with the same.

16. Locking/unlocking system of superimposable elements according to claim 15, characterized in that said first and second means of engagement (150, 250) consist of a projecting part and of a hollow, shaped such as to be reciprocally engaged, provided, respectively on said operating device (1) and on said first element (2), or vice versa.

17. Locking/unlocking system of superimposable elements, comprising a first element (2) or upper element, and a second element (3), or lower element, to be locked and unlocked, superimposed each other along a plane (4) of relative motion, and a operating device (1), said operating device (1) providing a plurality of interference elements (110, 120, 130), comprised of magnetic (120, 130) material, ferromagnetic material or magnetically inert (110) material, said first element (2) and said second element (3) providing each one the same number of a plurality of housings (210; 310), said plurality of housings (210; 310) of said first element (2) and of said second element (3) being reciprocally positioned so as to form aligned pairs of housings (210, 310), each one of said pairs of housings (210; 310) providing inside centering means (220, 320, 240), said system providing a plurality of first magnetic elements (230') having a first length, a plurality of second magnetic elements (230") having a second length, lower than the length of said plurality of first magnetic elements (230'), and a plurality of third magnetic elements (230"), having a third length equal to one half of the sum of said first and second lengths, the total height of said pairs of housings (210, 310) having a length equal to or longer than the double of said first length, inside each one of said pairs of housings (210, 310) being provided a pair of said magnetic elements (230', 230"; 230''') wherein said pairs of magnetic elements (230', 230", 230''' have a centre of gravity, each pair of said magnetic elements (230', 230"; 230''') consisting of one of said first (230') magnetic elements and of one of said second (230") magnetic elements, or a pair of said third (230") magnetic elements, each magnetic element (230', 230", 230''') of said pair of magnetic elements (230', 230"; 230''') having two ends, each of said ends having only one polarity and said only one polarity being opposite to the polarity of the other end of the same magnetic element (230', 230", 230''')

in each pair of said magnetic elements (230', 230"; 230'''), the position of each magnetic element (230', 230", 230''') with respect to the other magnetic element (230', 230", 230''') of the respective pair and the orientation of their polarity being combined randomly, so that the faced ends of the magnetic elements (230', 230", 230''') of each pair always have opposite polarity, and so that in the absence of interferences said faced ends of said pair of first and second magnetic elements (230', 230") correspond to said plane (4), and said faced ends of said pair of third magnetic elements (230''') are offset with respect to said plane (4), and wherein in the absence of interferences, said centering means (220, 320, 240) act on said pairs of magnetic elements (230', 230"; 230''') for keeping said centre of gravity of said pairs of magnetic elements (230', 230"; 230''') on said plane (4), so that when both (a): each pair of said magnetic elements (230', 230"; 230''') is subject to a rejection force and (b): each pair of said magnetic elements (230', 230"; 230''') is subject to an attraction force provoked by one of said plurality of interference elements (110, 120) made of magnetic or ferromagnetic material, said center of gravity of said pairs of magnetic elements (230', 230"; 230''') cannot be kept on said plane (4) causing the movement of said pairs of magnetic elements (230', 230"; 230''') within their respective pair of housings (210, 310), said plurality of interference elements (110, 120, 130) of said operating device being oriented and combined so that by bringing said operating device (1) close to one of said two elements (2, 3), one of said plurality of interference elements (110, 120, 130) only attracts or only rejects said pair of said first (230') and said second (230") magnetic elements in the respective pair of housings (210, 310) and only leaves unaltered said pair of said third magnetic elements (230") in the respective pair of housings (210, 310), so that said faced ends of said pairs of magnetic elements (230', 230"; 230''') are all aligned along said plane (4), permitting the relative motion of the two elements (2, 3)

wherein said centering means (220, 320, 240) consist of two magnetic elements positioned at the sides of each one of said housings (210, 310), inside which there are said pairs of magnets (230', 230"; 230''', 230''').

* * * * *